US005918426A

United States Patent [19]

Gifford et al.

[11] Patent Number: 5,918,426

[45] Date of Patent: Jul. 6, 1999

[54] FLEXIBLE DRIP RAIL

[75] Inventors: Thomas E. Gifford; Leon M. Ringenberg, both of Elkhart, Ind.

[73] Assignee: Atlantis Plastics, Inc., Elkhart, Ind.

[21] Appl. No.: 09/010,428

[22] Filed: Jan. 21, 1998

Related U.S. Application Data

[60] Provisional application No. 60/036,375, Jan. 23, 1997.

[51] Int. Cl.[6] ..... E04D 13/00; E04D 13/15

[52] U.S. Cl. ..... 52/97; 52/74; 52/518

[58] Field of Search ..... 52/97, 74, 518; 428/906

[56] References Cited

U.S. PATENT DOCUMENTS

| | | | |
|---|---|---|---|
| 3,248,827 | 5/1966 | Hardy | 52/97 X |
| 3,527,003 | 9/1970 | Woodard | 52/97 X |
| 4,154,028 | 5/1979 | Spaulding | 52/97 X |
| 5,526,626 | 6/1996 | Loucks | 52/518 |
| 5,548,940 | 8/1996 | Baldock | 52/518 X |

*Primary Examiner*—Christopher Kent
*Attorney, Agent, or Firm*—Baker & Daniels

[57] ABSTRACT

The present invention involves an extruded material capable of being rolled into a coil, for use on the edge of a roof as a molding. The extrusion comprises a polymer material with cross-sectional a roof, fascia, and hinged portions. The roof portion is adapted to attach to roofing material on the roof. The flexible hinge connects the roof portion and the fascia portion and is unitarily formed with the roof and fascia portions. The roof and fascia portions are formed of a hard plastic material, and the flexible hinge is formed of a plastic material having greater flexibility than the hard plastic material. The roof portion includes ribs for inhibiting water penetration between the roofing material and said roof portion. The roof portion includes a protrusion serving as a connecting location with the flexible hinge, either on an end generally parallel to the roof portion serving as the connecting location with the flexible hinge, or on a perpendicular end. The fascia portion is generally planar and includes a flexible angled lip adapted for bending away from the plane of the fascia portion. The fascia portion is formed from a hard plastic material, and the flexible angled lip is formed of a plastic having greater flexibility than the hard plastic material. The hinge is capable of positioning the roof portion and the fascia portion in a generally parallel, adjacent arrangement. The method of installing the molding includes positioning the roof portion adjacent the roof edge, applying force transverse to the roof portion and flexing the hinge so that the angle between the roof and fascia portions correspond to the angle between the roof and fascia, and attaching the roof portion to the roof. The molding material is provided as a coil, and so the positioning step includes cutting the molding material to the length of the roof edge. The angled lip is bent away from the fascia after the applying step.

18 Claims, 4 Drawing Sheets

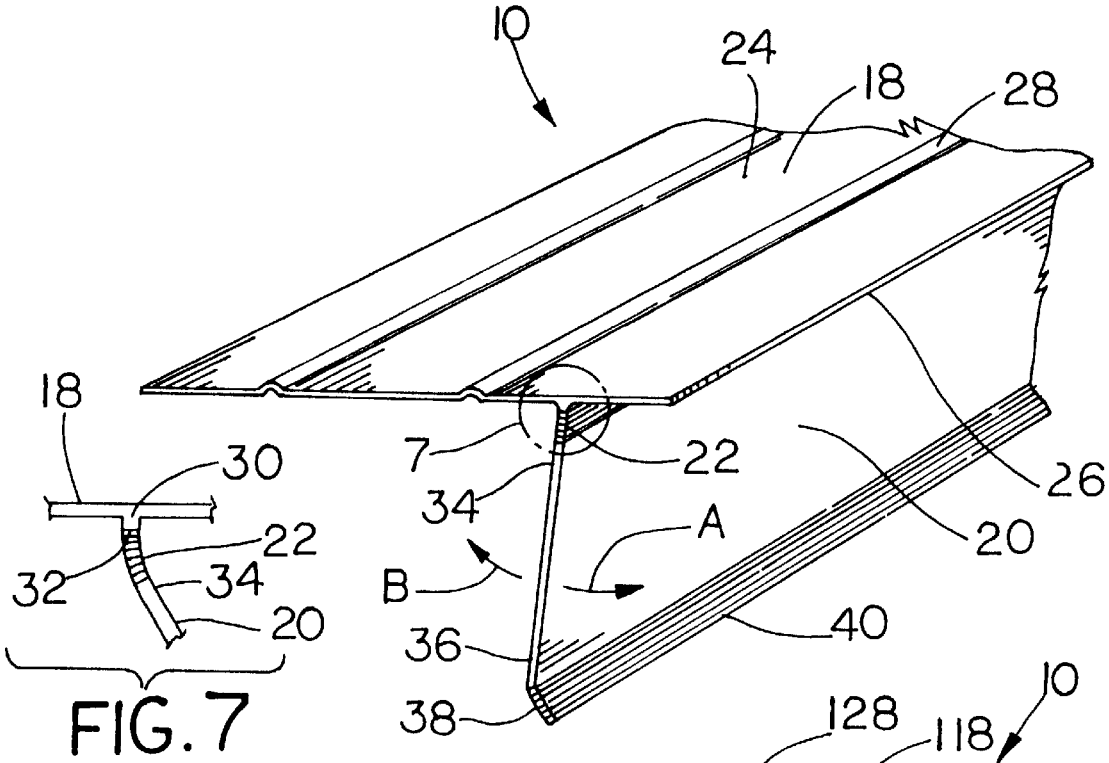
FIG. 7
FIG. 6
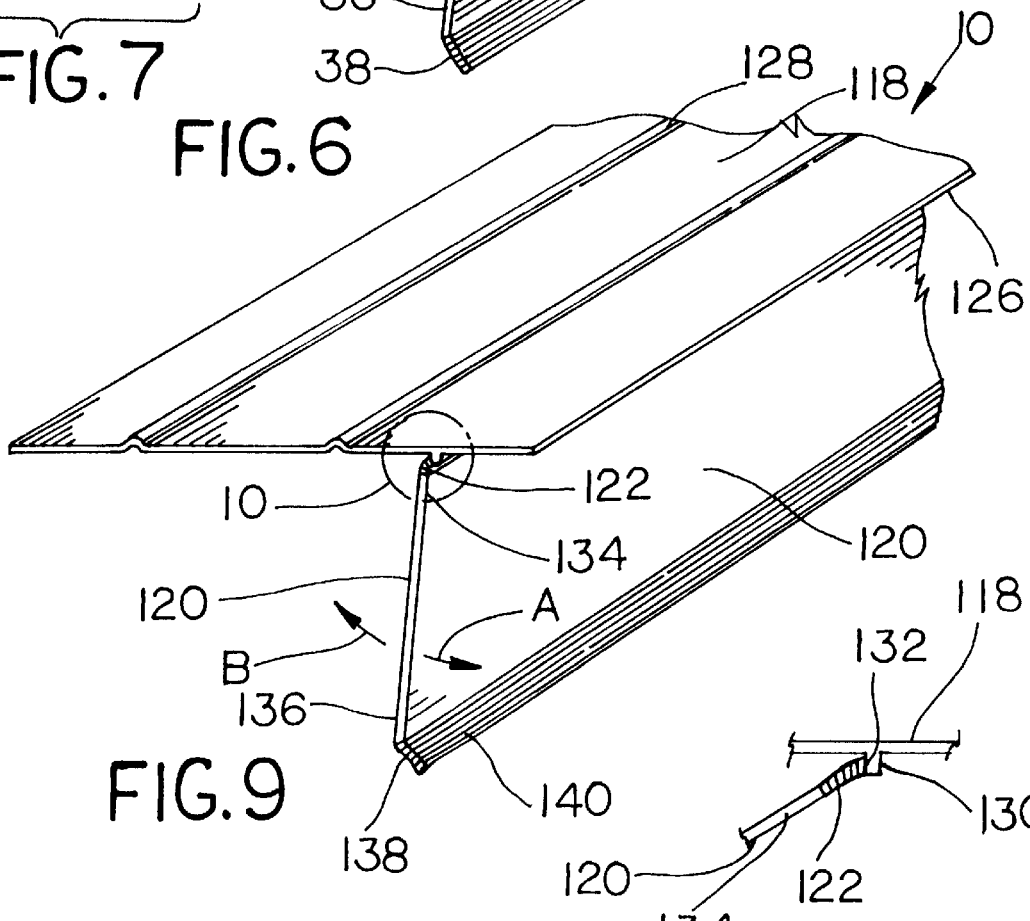
FIG. 9
FIG. 10

FLEXIBLE DRIP RAIL

CROSS REFERENCE TO RELATED APPLICATIONS

This application claims the benefit under Title 35, U.S.C. § 119(e) of U.S. Provisional Patent Application Ser. No. 60/036,375, entitled FLEXIBLE DRIP RAIL, filed on Jan. 23, 1997.

BACKGROUND OF THE INVENTION

1. Field of the Invention

The present invention relates generally to an extruded, continuous feed flexible drip rail for use on the edge of a roof.

2. Background Art

Drip rails are commonly installed at the edge of a roof in order to prevent water from rain or melting snow from leaking under the edge of the shingles or other roofing material. When shingles, rolled roofing, or even the more modern single ply roofing materials are installed on a structure a slight vacuum is formed along the perimeter of the roof between the roofing material and the underlying structure. This small vacuum tends to suck water into the small space between the roofing material and the roof structure in a process known as capillary action. In order to prevent capillary action a drip rail is commonly installed along the perimeter of the roof.

Drip rails are typically "L" shaped, with a first leg extending underneath the edge of the shingle parallel to the slope of the roof, and a second leg extending downwardly along the fascia. A portion of the first leg forms a ledge or overhang which extends past the edge of the roof, so that most water droplets will collect at the end of the ledge and fall to the ground. The downwardly extending leg typically terminates in a small outwardly extending protrusion or lip, which causes any remaining moisture from the roof to flow away from the fascia and collect at the edge of the lip, where the water eventually drips harmlessly to the ground.

Drip rails are commonly formed from extruded aluminum in standard lengths, with 10 foot sections being the most common. Unfortunately, the prior art drip rails have a number of drawbacks. First, when two sections of drip rail placed together the seam between the adjacent sections becomes an avenue for capillary action. A common solution is to apply caulk or other sealants to each seam, which greatly increases material costs as well as installation time. Second, the legs of the "L" shaped section are rigid and fixed relative to one another, and therefore unless the angle between the legs matches the angle between the roof and the fascia the legs create a gap between the drip rail and the fascia. This gap becomes a collection point for moisture and dirt and can even create a convenient nesting area for insects. Finally, the long rigid sections of drip rail are difficult to transport and install and are easily damaged during handling.

Accordingly, there exists a need for an improved drip rail that is flexible enough to be stored and shipped on a roll and which can be applied in a continuous section thereby eliminating the seam between adjacent sections. There also exists a need for a drip rail that has moveable legs to enable the drip rail to conform to the angle of any roof.

SUMMARY OF THE INVENTION

The present invention includes an adjustable hinge which allows the angle between the legs of the drip rail to adjust to conform to the angle of the roof, thus eliminating a potentially detrimental collection point for moisture, dirt or insects. The present flexible drip rail also can be continuously extruded and stored on a roll, which eliminates seams between adjacent sections and greatly simplifies the shipping, handling and installation of the drip rail.

The flexible drip rail according to the present invention includes a base leg and a moveable leg which are joined together by a flexible hinge, which enables the drip rail to fold to a flat position capable of being rolled onto a coil for convenient storage, shipping and handling. The adjustment of the legs relative to each other enables the base leg of the present drip rail to conform to the slope of the roof and also enables the moveable leg to conform to the angle of the fascia. A flexible angled lip attached to the edge of the moveable leg directs water droplets outward and away from the fascia board and yet permits the moveable leg to fold completely flat against the base leg so that the drip rail can be rolled onto a coil without buckling.

The drip rail of the present invention is preferably extruded using a commonly known dual durometer extrusion process, which uses a relatively stiff material for the base leg and the moveable leg and a relatively flexible material for the flexible hinge and the angled lip. Because the moveable leg and the angled lip fold substantially flat against the base leg, the extruded section can be rolled onto a coil or drum without buckling. Consequently, the rolled drip rail can be easily transported and handled. The drip rail is simply rolled out and cut to the desired length during installation, which completely eliminates waste.

Accordingly, it is an object of this invention to provide an improved drip rail for use on roofs that is continuous and eliminates seams between adjacent sections.

Another object of this invention is to provide a flexible drip rail that can be stored, shipped and handled on a roll and that enables the end user to simply unroll and cut the desired length.

A further object of this invention is to provide an improved flexible drip rail that conforms to the angle between the roof structure and the fascia.

A still further object of this invention is to provide an improved drip rail that eliminates large gaps between the drip rail and the fascia and/or roof structure.

These and other objects of the invention will become evident upon a reading of the following detailed description.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein:

FIG. 6 is a cross-sectional view of the flexible drip rail of FIG. 5 shown with the moveable leg extended away from the base leg;

FIG. 7 is an enlarged fragmentary view of the circumscribed portion of FIG. 6 showing the connection point between the flexible hinge and the base leg;

FIG. 9 is a cross-sectional view of the embodiment of FIG. 8 shown with the moveable leg extended away from the base leg; and FIG. 10 is an enlarged fragmentary view of the circumscribed portion of FIG. 9 showing the connection point between the flexible hinge and the base leg.

Figures 1, 2, 5, 8:
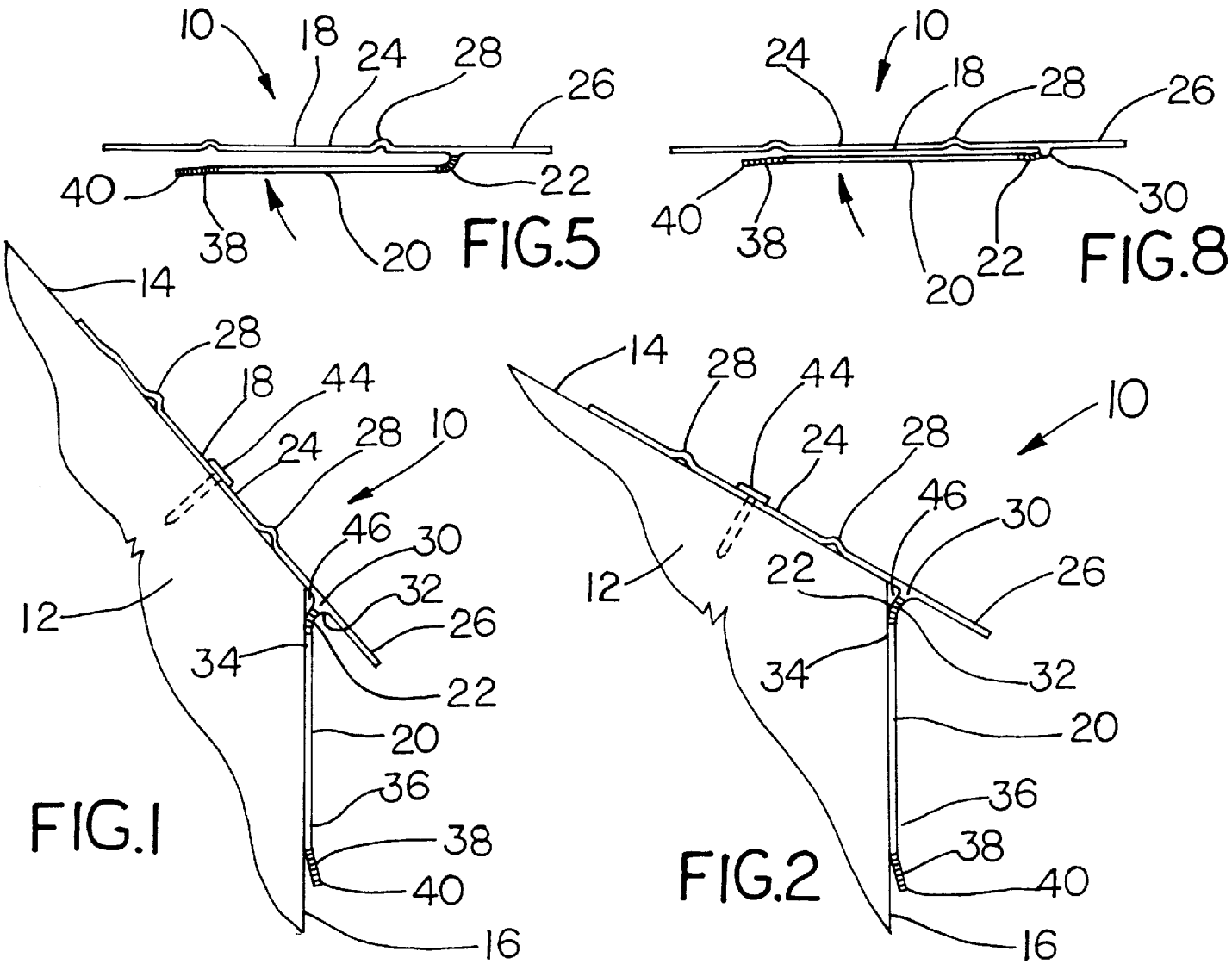
FIG. 1 is a fragmentary cross-sectional view of the flexible drip rail according to the present invention shown installed on the edge of a roof having a relatively steep pitch.
FIG. 2 is a fragmentary cross-sectional view of the flexible drip rail shown in FIG. 1 but shown installed on the edge of a roof having a relatively shallow pitch.
FIG. 5 is a cross-sectional view of the flexible drip rail shown in FIGS. 1 and 2 taken substantially along line 5—5 of FIG. 4 showing the moveable leg and the angled lip folded flat against the base leg in a configuration that permits the drip rail to be rolled onto a spindle for storage and shipping.
FIG. 8 is a cross-sectional view similar to that shown in FIG. 5 but shown with an alternate embodiment for the flexible hinge design.
Figure 3:
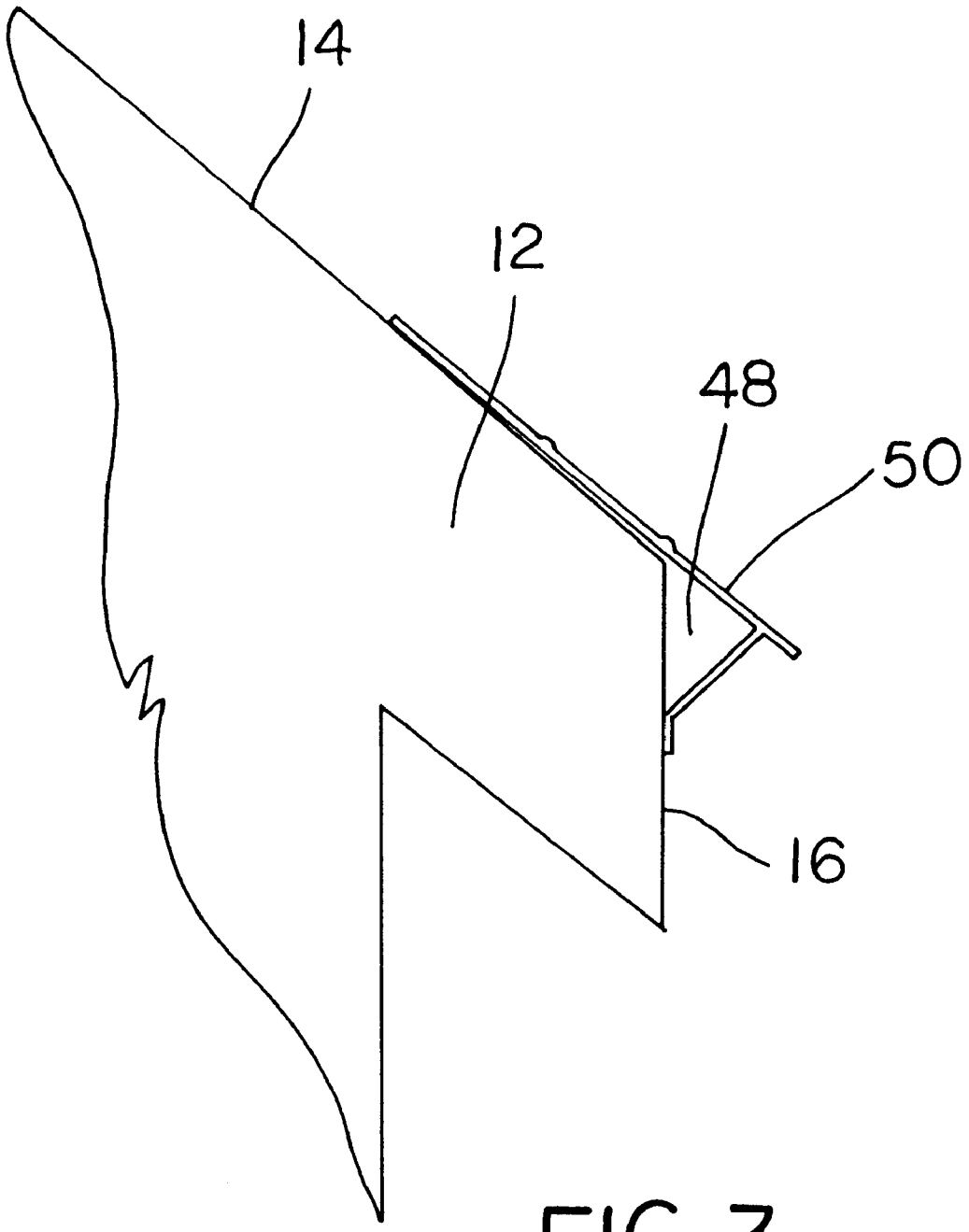
FIG.3 PRIOR ART
FIG. 3 is a fragmentary cross-sectional view of a prior art rigid drip rail shown installed on the edge of a typical sloped roof.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, in several forms, and such exemplifications are not to be construed as limiting the scope of the invention in any manner.

DETAILED DESCRIPTION OF THE INVENTION

The embodiment herein described is not intended to be exhaustive or to limit the invention to the precise form disclosed. It is chosen and described to explain the principles of the invention and its application and practical use to best enable others skilled in the art to follow its teachings.

Referring now to the drawings, FIGS. 1 through 7 show a flexible drip rail according to the present invention generally indicated by the reference numeral 10. Drip rail 10 is shown installed on the edge of a typical roof 12 having a sloped portion 14 and a fascia board 16. Drip rail 10 includes a base leg 18 and a movable leg 20 which are joined together by flexible hinge 22. Base leg 18 and moveable leg 20 are preferably constructed of rigid exterior grade PVC plastic, e.g. with a 70 or 80 durometer. Base leg 18 includes an attachment portion 24 which is typically attached to the sloped portion of the roof 14 by nails, roofing staples, or other fasteners 44 as are commonly employed in the art. Preferably, attachment portion 24 includes a series of protrusions or ribs 28 which provide an additional barrier against the ingress of water between the roofing material (not shown) and the drip rail 10, and also provide stiffness to drip rail 10. One end of base leg 18 forms an overhanging portion 26 which extends past flexible hinge 22 to form a cantilever. Base leg 18 further includes a protrusion 30 which forms an attachment surface 32 for the flexible hinge 22. As shown in FIG. 7, protrusion 30 extends in perpendicular fashion from base leg 18, and the attachment surface 32, which forms the connecting point for hinge 22, runs substantially parallel to base leg 18.

Movable leg 20 is attached to base leg 18 by flexible hinge 22 as shown in FIGS. 1, 2, 5 and 7. Moveable leg 20 includes an upper portion 34 which is attached to hinge 22, and also includes a lower portion 36 which includes flexible angled lip 38. Flexible hinge 22 and angled lip 38 are preferably formed from flexible PVC 90 durometer plastic. Angled lip 38 is attached to the lower portion 36 of movable leg 20 at an angle so that the tip 40 of angled lip 38 is spaced apart from fascia 16 as shown in FIGS. 1 and 2.

Figure 4:
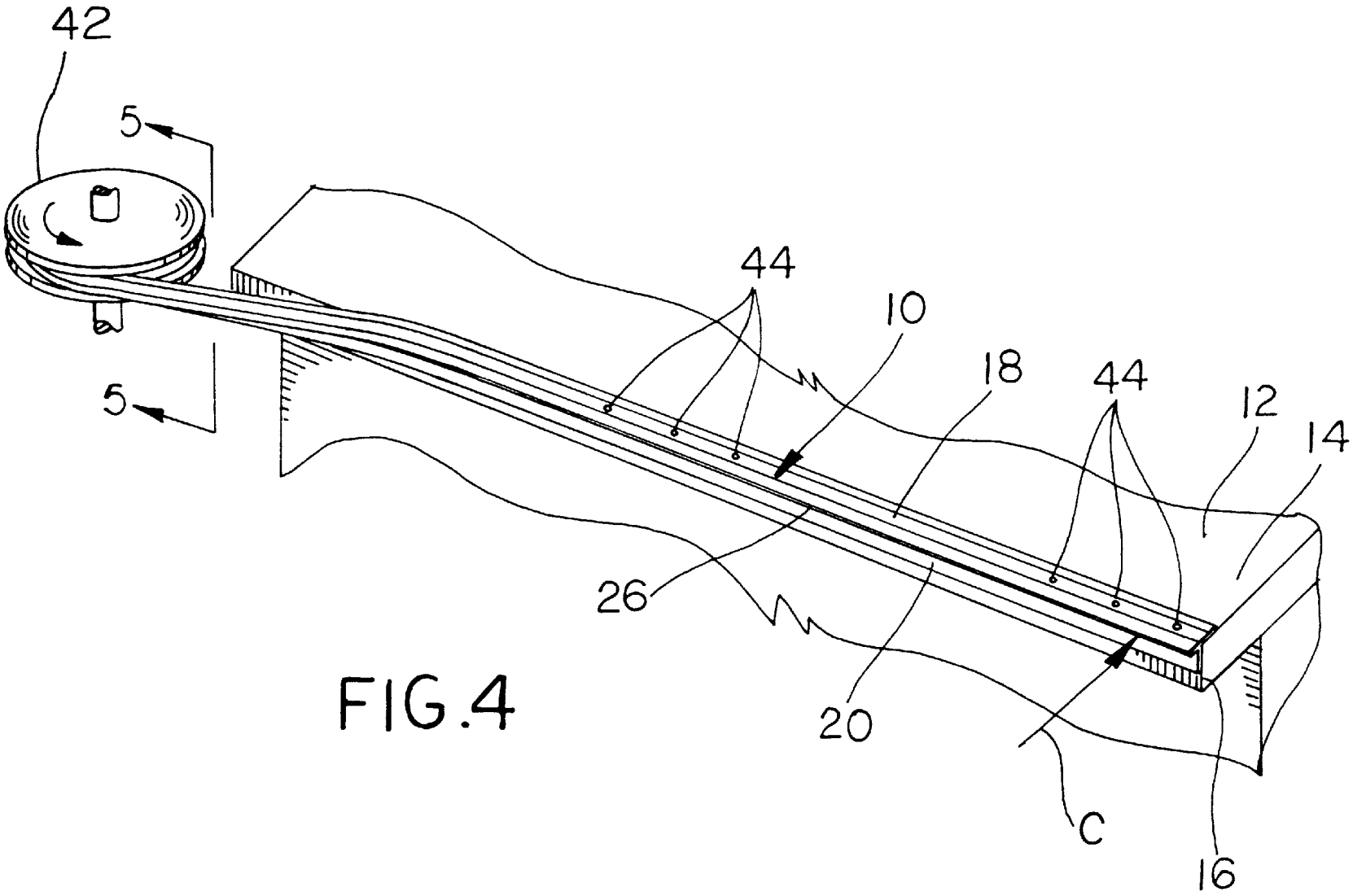
FIG. 4 is a fragmentary view in perspective of the flexible drip rail according to the present invention shown being unrolled and attached to the edge of a roof during the installation process.

Flexible drip rail 10 is preferably manufactured using a dual durometer extrusion process as is typically employed in the plastics manufacturing industry. Flexible hinge 22 permits moveable leg 20 to be folded flat against base leg 18 to the substantially flat configuration as is shown in FIG. 5. In such a substantially flat configuration, drip rail 10 is capable of being rolled along base leg 18 onto a coil 42 as shown in FIG. 4 in lengths of up to approximately 500 feet for convenient shipping, storage and handling. Flexible angled lip 38 folds flat adjacent base leg 18 such as shown in FIG. 5, which prevents buckling of lip 38 when drip rail 10 is rolled onto the coil 42 shown in FIG. 4.

In operation drip rail 10 is installed on roof 12 by unrolling the desired length from coil 42 as shown in FIG. 4. The installer (not shown) applies a force in the direction indicated by the reference arrow C, which flexes moveable leg 20 so that the angle between legs 18 and 20 matches the angle between the sloped portion 14 of roof 12 and the fascia 12. Drip rail 10 is then secured to roof 12 by installing fasteners 44 through attachment portion 34, and the roofing material such as shingles, rolled roofing, or a single ply roof (not shown) is installed according to common industry practices. As shown in FIG. 6, the angle of moveable leg 20 relative to base leg 18 is variable depending on the angle of roof 12 and fascia 16. For example, for applications in which the drip rail is installed on a roof having a steep pitch, moveable leg 20 of drip rail 10 is flexed towards the direction indicated by the reference arrow A, so that the final installed configuration matches that shown in FIG. 1. On the other hand, for applications in which the drip rail is installed on a roof having a shallower pitch, moveable leg 20 of drip rail 10 is flexed towards the direction indicated by the reference arrow B, so that the final installed configuration matches that shown in FIG. 2. Only a very small gap 46 is created between drip rail 10 and roof 12, compared to the much larger gap 48 created between the roof 12 and a prior art rigid roll formed aluminum drip rail 50 shown in FIG. 3.

FIGS. 8, 9 and 10 show an alternate embodiment of the invention. Drip rail 110 includes a base leg 118 and a movable leg 120 which are joined together by flexible hinge 122. Base leg 118 and flexible hinge 122 are preferably constructed of rigid exterior grade PVC plastic. One end of base leg 118 forms an overhanging portion 126 which extends past flexible hinge 122 to form a cantilever, and base leg 118 includes an attachment portion 124 which is attached to the sloped portion of the roof 114 by nails, roofing staples, or other fasteners (not shown) as are commonly employed in the art. Preferably, attachment portion 124 includes a series of protrusions or ribs 128 which provide an additional barrier against the ingress of water between the roofing material (not shown) and the drip rail 110. Base leg 118 further includes a protrusion which forms an attachment surface 132 for the flexible hinge 122. As shown in FIG. 10, protrusion 130 extends in perpendicular fashion from base leg 118, and the attachment surface 132, which forms the connecting point for a hinge 122, runs substantially perpendicular to base leg 118.

Movable leg 120 is attached to base leg 118 by flexible hinge 122. Moveable leg 120 includes an upper portion 134 which is attached to hinge 122, and also includes a lower portion 136 which includes flexible angled lip 138. Flexible hinge 122 and angled lip 138 are preferably formed from flexible PVC 90 durometer plastic. Angled lip 138 is attached to the lower portion 136 of movable leg 120 at an angle so that the tip 140 of angled lip 138 is spaced apart from fascia 116. While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A molding for use on the edge of a roof comprising:

a roof portion adapted to attach to roofing material on the roof;

a fascia portion; and a flexible hinge connecting said roof portion and said fascia portion, said flexible hinge being unitarily formed with said roof portion and said fascia portion, wherein said roof portion and said fascia portion are formed of a hard plastic material, and said flexible hinge is formed of a plastic material having greater flexibility than said hard plastic material.

2. The molding of claim 1 wherein said roof portion includes ribs for inhibiting water penetration between the roofing material and said roof portion.

3. A molding for use on the edge of a roof comprising:

a roof portion adapted to attach to roofing material on the roof;

a fascia portion; and a flexible hinge connecting said roof portion and said fascia portion, said flexible hinge being unitarily formed with said roof portion and said fascia portion, wherein said roof portion includes a protrusion serving as a connecting location with said flexible hinge and said protrusion has an end generally parallel to said roof portion serving as said connecting location with said flexible hinge.

4. The molding of claim 2 wherein said roof portion includes ribs for inhibiting water penetration between the roofing material and said roof portion.

5. A molding for use on the edge of a roof comprising:

a roof portion adapted to attach to roofing material on the roof;

a fascia portion; and a flexible hinge connecting said roof portion and said fascia portion, said flexible hinge being unitarily formed with said roof portion and said fascia portion, wherein said fascia portion is generally planar and includes a flexible angled lip adapted for bending away from the plane of said fascia portion, and said fascia portion is formed from a hard plastic material, and said flexible angled lip is formed of a plastic having greater flexibility than said hard plastic material.

6. The molding of claim 5 wherein said roof portion includes ribs for inhibiting water penetration between the roofing material and said roof portion.

7. A method of installing a molding on a roof edge adjacent to a fascia surface, said method comprising the steps of:

providing a plastic molding material, said molding material including a roof portion adapted to attach to roofing material on the roof, a fascia portion, and a flexible hinge connecting the roof portion and the fascia portion, the flexible hinge being unitarily formed with the roof portion and the fascia portion;

positioning the roof portion adjacent the roof edge;

applying force transverse to the roof portion and flexing the hinge so that the angle between the roof portion and the fascia portion corresponds to the angle between the roof and the fascia; and attaching the roof portion to the roof.

8. The method of claim 7 wherein the molding material is provided as a coil, and said positioning step includes cutting the molding material to the length of the roof edge.

9. The method of claim 7 wherein the molding material is also provided with a flexible angled lip at an end of the fascia portion, further including the step of bending the flexible angled lip away from the fascia after said applying step.

10. An extruded material capable of being rolled into a coil, comprising a polymer material with cross-sectional portions including:

a roof portion;

a fascia portion; and a flexible hinge connecting said roof portion and said fascia portion, said flexible hinge being unitarily formed with said roof portion and said fascia portion wherein said roof portion and said fascia portion are formed of a hard plastic material, and said flexible hinge is formed of a plastic material having greater flexibility than said hard plastic material.

11. The extruded material of claim 10 wherein said roof portion includes ribs for inhibiting water penetration between the roofing material and said roof portion.

12. The extruded material of claim 10 wherein said hinge is capable of positioning said roof portion and said fascia portion in a generally parallel, adjacent arrangement.

13. An extruded material capable of being rolled into a coil, comprising a polymer material with cross-sectional portions including:

a roof portion;

a fascia portion; and a flexible hinge connecting said roof portion and said fascia portion, said flexible hinge being unitarily formed with said roof portion and said fascia portion, wherein said roof portion includes a protrusion serving as a connecting location with said flexible hinge and said protrusion has an end generally parallel to said roof portion serving as said connecting location with said flexible hinge.

14. The extruded material of claim 13 wherein said roof portion includes ribs for inhibiting water penetration between the roofing material and said roof portion.

15. The extruded material of claim 13 wherein said hinge is capable of positioning said roof portion and said fascia portion in a generally parallel, adjacent arrangement.

16. An extruded material capable of being rolled into a coil, comprising a polymer material with cross-sectional portions including:

a roof portion;

a fascia portion; and a flexible hinge connecting said roof portion and said fascia portion, said flexible hinge being unitarily formed with said roof portion and said fascia portion, wherein said fascia portion is generally planar and includes a flexible angled lip adapted for bending away from the plane of said fascia portion, and said fascia portion is formed from a hard plastic material, and said flexible angled lip is formed of a plastic having greater flexibility than said hard plastic material.

17. The extruded material of claim 16 wherein said roof portion includes ribs for inhibiting water penetration between the roofing material and said roof portion.

18. The extruded material of claim 16 wherein said hinge is capable of positioning said roof portion and said fascia portion in a generally parallel, adjacent arrangement.

* * * * *